US007155840B1

(12) United States Patent
Carbonaro

(10) Patent No.: US 7,155,840 B1
(45) Date of Patent: Jan. 2, 2007

(54) DEVICE FOR MOUNTING DECORATIVE AND FUNCTIONAL ITEMS

(76) Inventor: Gregory S. Carbonaro, 22523 WillowLakes Dr., Lutz, FL (US) 33549

( * ) Notice: Subject to any disclaimer, the term of this patent is extended or adjusted under 35 U.S.C. 154(b) by 0 days.

(21) Appl. No.: 11/082,601

(22) Filed: Mar. 16, 2005

Related U.S. Application Data

(60) Provisional application No. 60/553,436, filed on Mar. 16, 2004.

(51) Int. Cl.
*B25H 7/04* (2006.01)
*G01B 5/24* (2006.01)

(52) U.S. Cl. ..... 33/613; 33/451; 33/666

(58) Field of Classification Search ..... 33/613, 33/666, 574, 577, 451, 452, 464, 474
See application file for complete search history.

(56) References Cited

U.S. PATENT DOCUMENTS 1,566,509 A * 12/1925 Schwanz ..... 33/666
4,241,510 A * 12/1980 Radecki ..... 33/613
4,485,561 A * 12/1984 Hopkins, Sr. ..... 33/574
5,471,760 A * 12/1995 Farris ..... 33/613
5,509,213 A * 4/1996 Kelly et al. ..... 33/613
6,026,584 A * 2/2000 Wegman ..... 33/613
6,029,362 A * 2/2000 Miodragovic ..... 33/666
6,032,378 A * 3/2000 Null ..... 33/613
6,473,983 B1 * 11/2002 Gier ..... 33/613
6,739,065 B1 * 5/2004 Hofmeister et al. ..... 33/613
6,883,244 B1 * 4/2005 Rimback ..... 33/613
6,898,862 B1 * 5/2005 Oberst ..... 33/613
6,971,184 B1 * 12/2005 Prevost ..... 33/613

* cited by examiner

*Primary Examiner*—R. Alexander Smith
(74) *Attorney, Agent, or Firm*—Dorothy S. Morse

(57) ABSTRACT

A device for easy positioning, leveling, marking and hanging of all types of pictures, sconces, decorative shelves, mirrors, and other devices to be mounted on a support surface. It has elongated vertical and horizontal support members attached together, each preferably with resilient legs. The vertical support has a handle at one end, a surface rest at its other end, and a rotatable sliding level. Sliding hook clips are positioned along the horizontal support, each having a front hook for holding an item to be hung while positioning and marking with an opposed marking implement take place. One or more hook clips can be used simultaneously. Flexing or compression of legs, soft pads, vertical support member, and/or horizontal support member reduces the wall stand-off distance of the device and causes the aligned marking implements to contact and mark the wall exactly where the held item should be permanently mounted.

20 Claims, 10 Drawing Sheets

DEVICE FOR MOUNTING DECORATIVE AND FUNCTIONAL ITEMS

CROSS-REFERENCES TO RELATED APPLICATIONS

This patent application relates to the currently pending U.S. provisional patent application Ser. No. 60/553,436, which was filed on Mar. 16, 2004 by the same inventor and for substantially the same subject matter. All benefit of such co-pending provisional patent application is herein requested.

BACKGROUND OF THE INVENTION

1. Field of the Invention

The present invention relates generally to devices for hanging objects from a wall, such as picture hanging devices, and more specifically it relates to a picture, sconce, decorative shelf and mirror hanging device for allowing easy positioning, leveling, marking and hanging of all types of pictures, sconces, decorative shelves, mirrors, clocks, artwork, and/or other objects that one might want to hang in a level orientation from a specifically targeted area on a vertically extending surface, such as but not limited to a wall.

2. Description of the Related Art

It can be appreciated that picture hanging devices have been in use for years. Typically, picture hanging devices are comprised of various devices for aiding in the alignment and hanging of pictures. For example U.S. Pat. No. 5,180,135 to Hindall discloses a device that supports a picture and includes an alignment gauge and positioning arm to allow marking the location of a hook on a wall targeted for hanging that picture. However, the Hindall disclosure does not provide a method for hanging heavier pictures requiring more than one hook. The U.S. Pat. No. 5,103,574 to Levy shows a measuring tool and a mechanism for horizontal or vertical alignment with the wall. However, the device does not include temporary hooks similar to those used with the present invention, and from which a picture or sconce can be hung, to locate a position on the wall for their placement. The U.S. Pat. No. 5,509,213 to Kelly discloses a way in which to scribe positions on a wall for hanging pictures with one or two hooks. However the Kelly device does not provide a single step for positioning a picture on the wall and marking the position where a user wants it hung. Another prior art picture hanging device is the Rimback device disclosed in published U.S. patent application No. 2003/0229999 A1. The Rimback device addresses and overcomes some of the problems with prior art picture hangers, but is deficient in many other ways, including the hanging of other types of decorative and functional wall items.

The main problems with conventional picture hanging devices are that they are primarily for hanging pictures and are deficient in the area of hanging other two-hook items such as wall sconces, decorative shelves, mirrors, clocks, and pictures with integral mounting holes or mounting clips of differing widths. While the Rimback device will allow for the hanging of items needing one or two wall hooks, an important limitation of the Rimback device is that its alignment hooks and marking holes are in fixed, pre-determined and non-adjustable positions. In contrast, the hooking clips of the present invention can be located in infinitely variable positions upon its horizontal support member. Consequently the Rimback device does not lend itself well to the vast variance of widths found between mounting holes and mounting clips on items intended for wall mounting, such as but not limited to wall sconces, decorative shelves, mirrors and some pictures. Because of this, the Rimback device and others like it are limited primarily to hanging wire mounted pictures, wherein the spacing or width between the placement of the wall hooks is not critical to hanging. However, items intended for vertical hanging which have two or more integral fixed position mounting holes or mounting clips are nearly impossible to hang with the Rimback device and other similar prior art devices, to include decorative items designed to be wall-mounted that are "one-of-a-kind" works of decorative art when it comes to mounting them. For although several of theses "one-of-a-kind" works may appear to be duplicates of one another, or near duplicates, from the front, each is produced without the precision of automation and consequently has integral mounting holes or mounting clips that vary widely in spacing and frequently are out of alignment with each other. Thus, even though wall hooks that are in a level orientation relative to one another are used to mount such a "one-of-a-kind" work, once hung it generally does not have a level appearance. As a result, fixed width, non-adjustable hanging devices, such as the Rimback and similar prior art hanging devices, can not be used effectively to hang such "one-of-a-kind" items, as their non-adjustable fixed width mounting capability can not accommodate the vast variations in mounting hole or mounting clip widths existing in a wide array of decorative and functional wall items. Another problem with conventional picture hanging devices is that the integral mounting holes or mounting clips on many hand made wall sconces, decorative shelves, mirrors, pictures, and other items are markedly out of alignment relative to each other and, in a similar manner to the "one-of-a-kind" items mentioned above, and use of level markings on a wall for placement of wall hooks to hang them will not result in a wall-mounted item with a level appearance. This variation in alignment makes it highly improbable that an installer using any of the currently available hanging devices will be able to mark a wall for hook placement so that unique decorative items can be hung level without having to make at east one surplus hole in the wall. Another problem with conventional picture hanging devices is that they often damage, mark or scrape the wall around a targeted hanging location as they are being used to position a picture. This is because they provide no mechanism or means to hold the picture away from the wall prior to and after wall marking, or prevent the edges of the picture or the apparatus itself from contacting the wall while it is being used.

While known prior art devices may be suitable for the particular purpose they address, they are not generally as versatile as the present invention, which allows easy positioning and time-saving leveling, marking and hanging of all types of pictures, sconces, decorative shelves, artwork, clocks, mirrors and other devices from a vertically extending surface. The main problem with known picture hanging devices is that they are primarily effective for hanging pictures on a wall from a single hook and typically deficient in the area of hanging items requiring two wall hooks, particularly wall sconces, decorative shelves, mirrors, artwork, and pictures with integral mounting holes or mounting clips having differing spaced-apart widths. Although the Rimback and other similar devices will allow for the hanging of items with one or two hooks, they are significantly limited by their alignment hooks and marking holes being in fixed, non-adjustable positions. Because of this, the Rimback and other similar hanging devices are limited primarily to hanging wire mounted pictures, since with wire mounted pictures the spacing or width between the placement of the wall hooks is not critical to hanging.

In these respects, the picture, sconce, decorative shelf, clock, artwork, mirror decorative and functional item hanging device according to the present invention substantially departs from the conventional concepts and designs known in the prior art, and in so doing provides an apparatus primarily developed for the purpose of allowing easy and time-efficient positioning, leveling, marking and first-time hanging of all types of pictures, sconces, decorative shelves, clocks, artwork, mirrors, and other decorative and functional items against a vertically extending surface even though integral mounting holes or mounting clips on the item to be hung are misaligned. No other invention is known with all of the features and advantages of the present invention.

SUMMARY OF THE INVENTION

In view of the disadvantages inherent in known types of picture hanging devices, some of which have been identified above, the present invention provides a new, time-efficient and first-time accurate hanging device for pictures, sconces, decorative shelves, clocks, artwork, mirrors and other decorative and functional items that can be used for easy centering, leveling, marking, and hanging thereof in a targeted location even when integral mounting holes and clips placed thereon during manufacture are misaligned.

The general purpose of the present invention, which will be described subsequently in greater detail, is to provide a new hanging device for pictures, sconces, decorative shelves, clocks, artwork, mirrors, and other decorative and functional devices that have many of the advantages of the picture hanging devices mentioned heretofore, in addition to many novel features and a novel structure that is not anticipated, rendered obvious, suggested, or even implied by any of the known prior art picture hanging devices, either alone or in any combination. For efficient and clear discussion of the present invention in the ensuing paragraphs, a reference will typically be made to the hanging of a picture or sconce on a wall. However, it is to be understood that, unless otherwise mentioned or disclaimed, any reference to an "item" to be hung shall include all decorative and functional items for which mounting in a specifically targeted location is intended, and any reference to a "wall" will include all targeted mounting surfaces, whether vertically extending or not. Also, since the present invention can be used in any orientation, it is to be also understood that the words 'vertical', 'horizontal', 'upper', 'lower', 'bottom', 'left', 'right, and the like are simply arbitrary designations relating to its typical upright orientation during use, and they have only been utilized for the purpose of providing a clear and efficient disclosure. Thus, all such words herein should not be considered as limiting, unless clearly and specifically noted otherwise.

The present invention embodiments each comprise an elongated Vertical Support member attached to an elongated Horizontal Support member, in combination with an Adjustable Level and sliding Hook Clips for centering, leveling, marking, and hanging an item on a vertically extending surface in a targeted location, although placement of items in a precise position on surfaces with other spatial orientations could also be accomplished with the present invention. The Vertical Support member has opposing ends with a Handle at one end and a Surface Rest at its other end that is used to rest/support the back surface of the item to be hung, such as but not limited to a picture or sconce. Typically, the present invention is used with its handle at the top. However, in differing applications, such as when an item is to be hung close to a ceiling and the Handle would be in the way, use of the present invention with the handle in other locations is also contemplated. Therefore, even though the discussion herein mentions the Handle or Adjustable Level on the 'upper section', 'upper portion', or 'top end' of the Vertical Support member, such designations are arbitrary and used simply as a reference to provide a concise description of the invention. Also, although the Surface Rest typically has a disk-shaped configuration with a flat surface to support an item to be hung, other perimeter and configurations are also contemplated, such as but not limited to a hexagonal perimeter and a tripod surface structure. An integral Adjustable Level is attached to the upper section of the Vertical Support member and used against the upper (or most adjacent) surface of the item resting or supported upon the Surface Rest to level that item in a targeted display location prior to marking of the positions on the wall where hooks or other picture hangers are to be installed to support the item while it is on display. Resilient Legs that are compressible and/or flexible are connected to each end of the Vertical Support member and Horizontal Support member, for use as stand offs to keep the support members and/or the selected item to be hung from directly contacting the wall against which that item will be mounted at any time during the centering, leveling, marking and mounting process. Legs may also have soft, flexible or compressible material on their distal ends that provides the needed increment of wall-ward movement that allows wall marking to occur, or the configuration and/or material composition of the Vertical and Horizontal Support members may contribute to the amount of wall-ward compression or flexing needed for wall marking. Sliding Hook Clips can be positioned in an infinite number of positions along the Horizontal Support member and used to engage aligned and misaligned integral mounting holes or mounting clips on the back surface of the item intended for hanging or mounting. Each Hook Clip has a temporary hook on its front side that can be used to temporarily hold a picture, sconce, or other item in a fixed position during the centering, leveling, and wall marking steps, as well as provide a holding receptacle for a pencil or marking implement on its back side that is perfectly aligned with the temporary hook on the front. One, two, or more Hook Clips can be used simultaneously on the Horizontal Support member. Flexing or compression of the resilient Legs, and/or compressible material, Vertical Support member, and Horizontal Support member, as a result of a wall-ward force applied by the user to the Support members, reduces the wall stand off distance and causes the marking implements to contact and mark the wall exactly where it is intended that the picture or other item resting against the Support Rest be permanently hung. The marking implements can be integral with the Hook Clips, or attached, and further may make a scratch, deposit a small amount of permanent marking composition, deposit an easily removable mark, deposit a mark with water or other fluid that evaporates in a short amount of time, or otherwise identify the location on a wall where wall hooks should be located for hanging the selected item with first-time accuracy in a targeted position. The Vertical Support member can consist of one or more elongated components or rails that can be capable of flexing or not. The Horizontal Support member can also consist of one or more elongated components or rails that are capable of flexing so as to assist in reducing the stand off distance of the present invention marking means from a wall so that wall marking is able to take place. Stand off distance reduction for marking can also be provided at least in part by a spring, flexing, resilient or other connection between the Vertical and Horizontal Support members and their associated Legs. The Handle is formed in a shape suitable to be held by an adult human hand and is attached to, or formed in or made a part of, the top end of the Vertical Support member. The exposed area on the Surface Rest attached to the opposing bottom end of the Vertical Support member, and upon which an item intended for hanging is temporarily held, is preferably flat, although it can also have a configuration with multiple raised perimeter protrusions, a tripod structure, or any other configuration that serves as a resting platform that evenly accommodates and supports without injury the back surface of the item to be hung. The Adjustable Level of the most preferred present invention embodiment consists of a level indicator, such as a bubble level, that is mounted in an assembly that can rotate and slide to any position along the top portion of the Vertical Support member to accommodate different sizes of pictures, sconces, or other items intended for vertical hanging. The resilient Legs include a structure having a distal end and a proximal end. Each end of the Vertical Support member and Horizontal Support member has a Leg that is used as a stand off to keep both Support members and the item intended for hanging from directly contacting the wall during centering, leveling, and wall marking use. The wall stand off distance can be dynamically reduced by Leg structure, the Support members, the structure of additional components used with the Legs, or a combination thereof. Each of the Hook Clips in the most preferred present invention embodiment has a U-shaped main body with a temporary hook on its front side and a pencil or marking implement holding receptacle on its back side, the center of which is directly behind and aligned with the center of the cradle portion of the temporary hook on the front side. The Hook Clips are designed to slide and/or be placed at any position along the Horizontal Support member, with one or multiple Hook Clips being used as required by the application. Thus, when an item intended for vertical hanging is positioned with its back surface against the Surface Rest, and the sliding Hook Clips are moved along the Horizontal Support member to the positions where integral mounting holes or mounting clips are located on the back surface of the item until their temporary hooks each engage one of the mounting holes or clips, and further when the Adjustable Level is moved into contact with an adjacent edge of the item, the item and present invention embodiment holding it can be moved as a unit for centering relative to a targeted location on a wall. Then with the assistance of the Handle to maneuver the combined item and embodiment, centering, leveling, and wall marking can take place. Once the item is centered in the target location, it is rotated until the Adjustable Level identifies a level orientation. Then, even when the integral mounting holes or mounting clips made or installed during manufacture are misaligned, which often happens, when a user of the present invention applies a wall-ward force against the Vertical and Horizontal Support members, the stand off distance between the present invention and the wall is reduced and the wall is marked for first time accurate, time-saving placement of wall hooks for hanging the intended item in a level orientation in the targeted location.

There has thus been outlined, rather broadly, the more important features of the invention in order that the detailed description thereof may be better understood, and in order that the present contribution to the art may be better appreciated. There are additional features of the invention that will be described hereinafter.

In this respect, before explaining at least one embodiment of the invention in detail, it is to be understood that the invention is not limited in its application to the details of construction and arrangement of components set forth in the following description and accompanying drawings. The invention is capable of other embodiments and of being practiced and carried out in various alternative, but not patentably distinct, ways. Also, it is to be understood that the phraseology and terminology employed herein are for the purpose of the description and should not be regarded as limiting.

A primary object of the present invention is to provide a picture, sconce, decorative shelf, clock, artwork, mirror, and other decorative or functional item hanging device that will overcome the shortcomings of the prior art devices known for hanging an item against a vertically extending surface, such as but not limited to a wall.

An object of the present invention is to provide a picture, sconce, decorative shelf, clock, artwork, mirror and other decorative or functional item hanging device for allowing the easy centering, leveling, first-time accurate marking, and hanging of a wide variety of such items.

Another object is to provide a picture, sconce, decorative shelf, clock, artwork, mirror, and other decorative or functional item hanging device that will mark a wall for the positioning of hooks to allow the hanging of items with various width integral mounting holes or mounting clips, whether they are in perfect alignment with one another or not.

Another object is to provide a picture, sconce, decorative shelf, clock, artwork, mirror, and other decorative or functional item hanging device that will hold the item to be hung or mounted at a pre-determined stand off distance safely away from the wall, or other surface intended for hanging or mounting the item, while the item is being moved and positioned for its final placement so that neither the present invention nor the item will injure the targeted mounting wall or surface, with the stand offs being compressible or flexible so that once the final hanging position in a targeted location is selected, a wall-ward force applied to the hanging device will compress the flexible or compressible stand off and bring the integral marking implements into contact with the wall at the locations needed for wall hook placement.

Another object is to provide a picture, sconce, decorative shelf, clock, artwork, mirror, and other decorative or functional item hanging device that will have adjustable position temporary hooks that are infinitely variable to accommodate and hold all types of items with integral mounting holes or mounting clips of various widths and irrespective of the spacing between them.

Another object is to provide a picture, sconce, decorative shelf, clock, artwork, mirror, and decorative or functional item hanging device that will have adjustable position temporary hooks with integral pencil or marking implement holders in perfect alignment with and mounted directly behind each temporary hook, so that the tip of a pencil or other marking implement used will come into contact with the wall when final position of the item to be hung is visually centered and leveled by the installer and the installer then compresses the flexible or compressible stand off distance using a wall-ward push to bring the tip of the marking implement or implements into contact with the surface of the wall or other mounting surface to mark the exact position needed for wall hook placement and achieve first-time accurate, centered and level item mounting.

Another object is to provide a picture, sconce, decorative shelf, clock, artwork, mirror and decorative or functional item hanging device that will have an integral, height positionable, and rotatable level indicator that can be brought into contact with the top or other adjacent portion of the item being hung so as to reveal when the item is in a level orientation. Thus, if the item to be hung has mounting holes or mounting clips that are out of relative alignment with each other, this will become apparent through the use of the level indicator, and to compensate for this, the entire hanging device and item as a unit can be rotated relative to the adjacent ground or floor surface once it is centered within the targeted mounting location. Once visually adjusted to a level orientation, the installer applies wall-ward pressure that temporarily compresses the flexible or compressible stand offs a sufficient amount to bring integral marking devices into contact with the wall and mark the exact wall hook positions needed to hang the picture, sconce, decorative shelf, mirror, or other item in a visually level orientation within the targeted mounting area.

Other objects and advantages of the present invention will be revealed to readers of the disclosure herein, and it is intended for such other objects and advantages that are so revealed and obvious to a person skilled in the art to also be within the scope of the present invention. Thus, to accomplish the above and related objectives, this invention may be embodied in the form illustrated in the accompanying drawings, as wel as other related embodiments. Thus, the accompanying drawings are illustrative only and provide one preferred embodiment of the present invention, and it is contemplated for changes to be made in the specific construction illustrated without departing from the scope of the present invention.

BRIEF DESCRIPTION OF THE DRAWINGS

Various other objects, features and attendant advantages of the present invention will become fully appreciated as the present invention becomes better understood when considered in conjunction with the accompanying drawings, in which like reference characters designate the same or similar parts throughout the several views, and wherein.

DETAILED DESCRIPTION OF THE INVENTION

Figure 1:
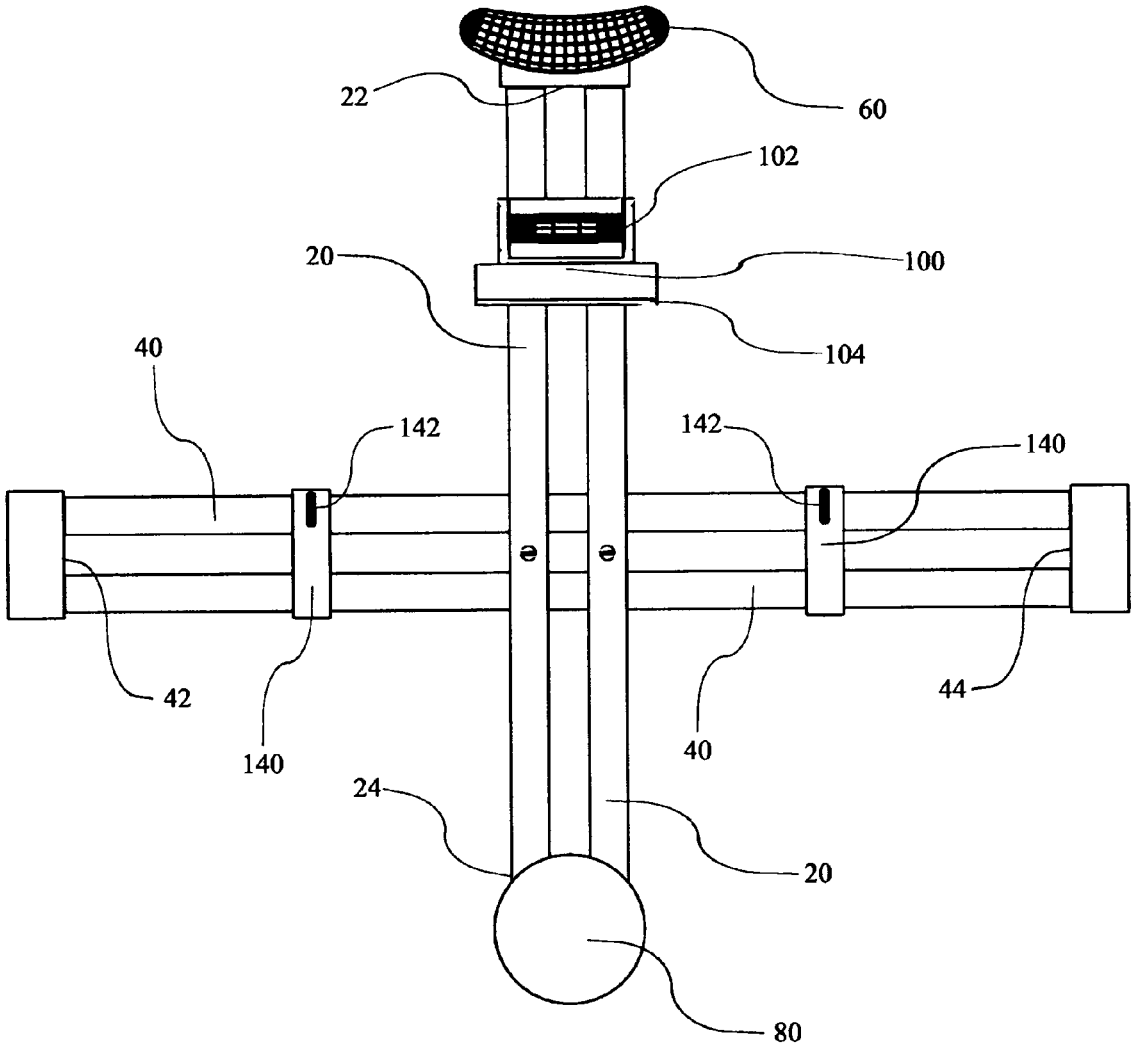
FIG. 1 is a front view of the most preferred embodiment of the present invention.
Figure 2:
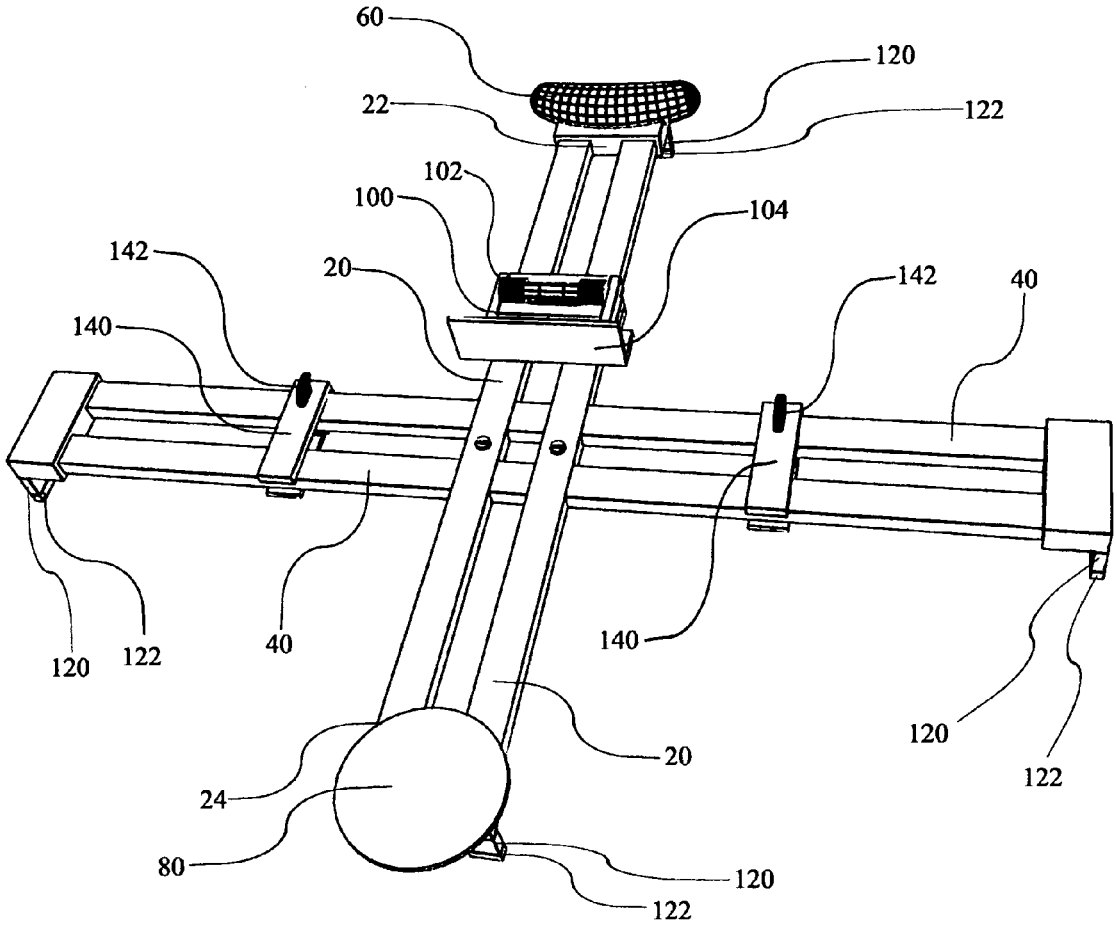
FIG. 2 is a perspective view of the most preferred embodiment of the present invention.
Figure 3:
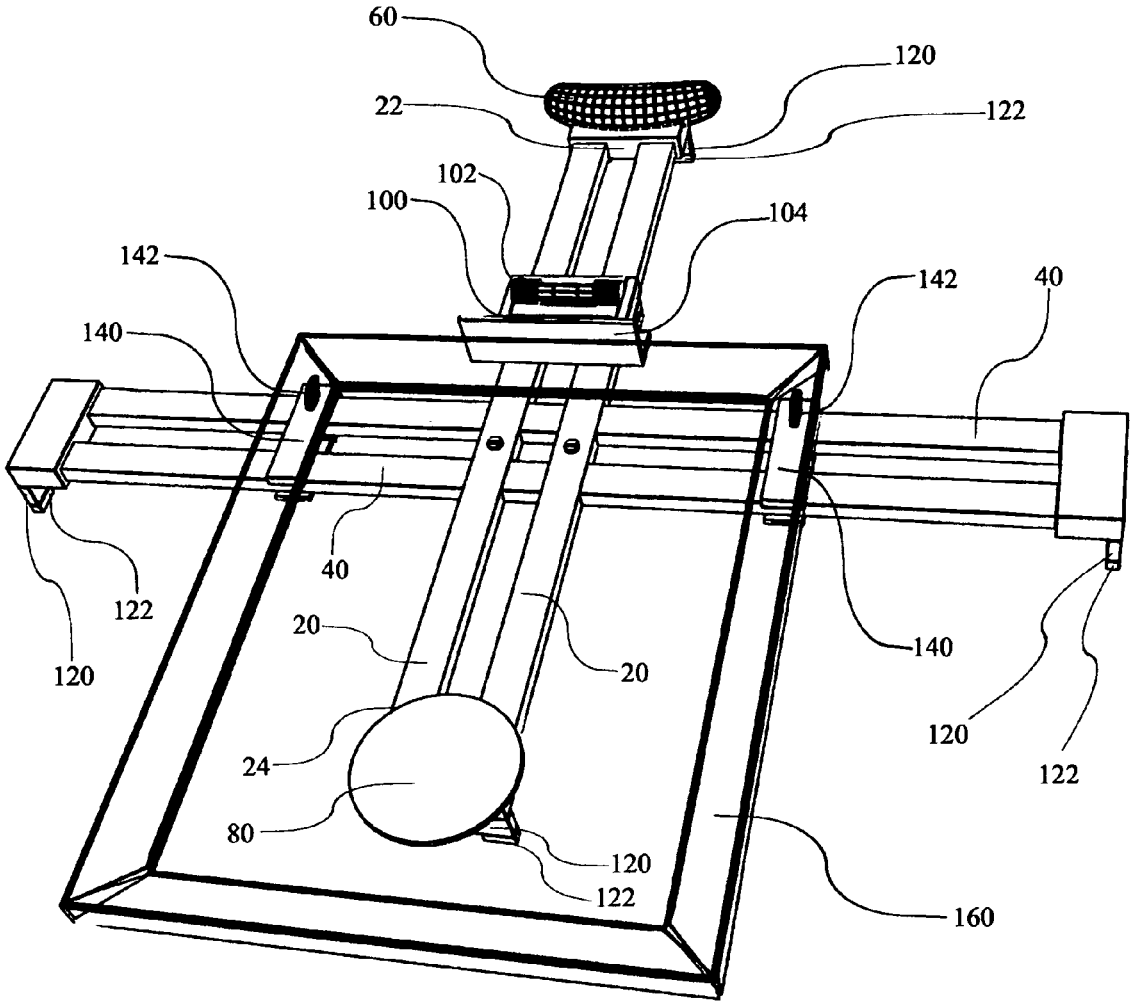
FIG. 3 is a perspective view of the most preferred embodiment of the present invention holding a picture, with the sliding Hook Clips aligned with portions of the picture intended for engagement with wall mounted hooks, and also with the portion of the present invention situated behind the picture being visible for illustrations purposes, even though structure behind the picture would ordinarily be hidden from view.
Figure 4:
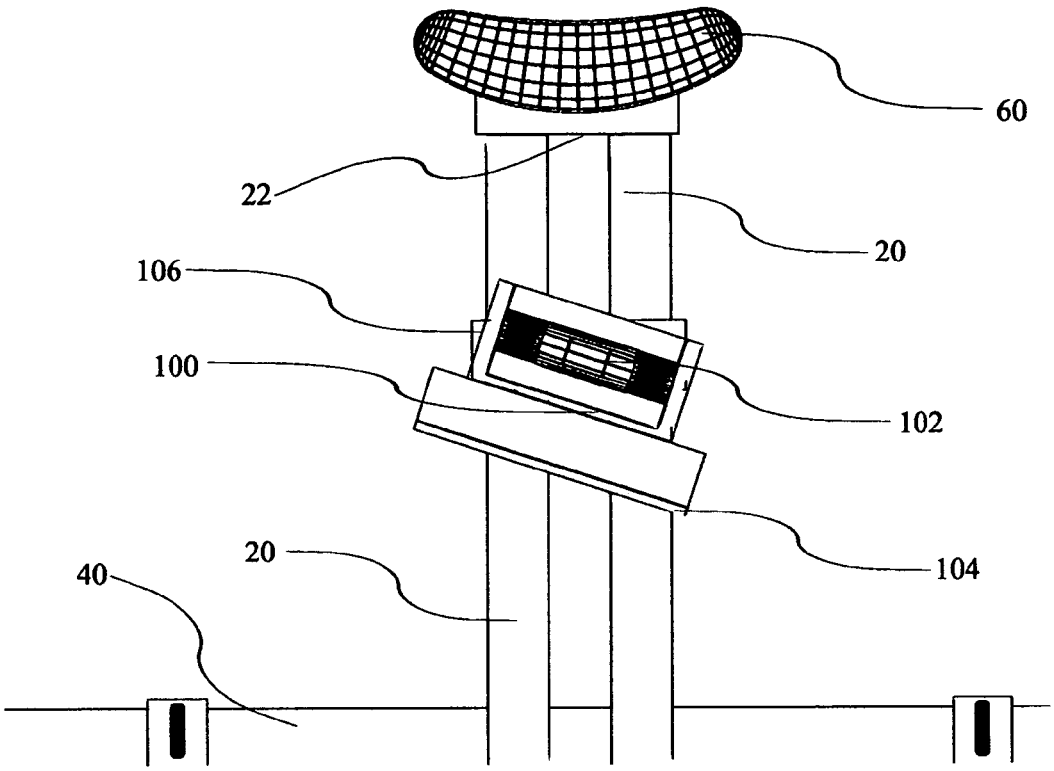
FIG. 4 is a front sectional view of the Adjustable Level component in the most preferred embodiment of the present invention.
Figure 5:
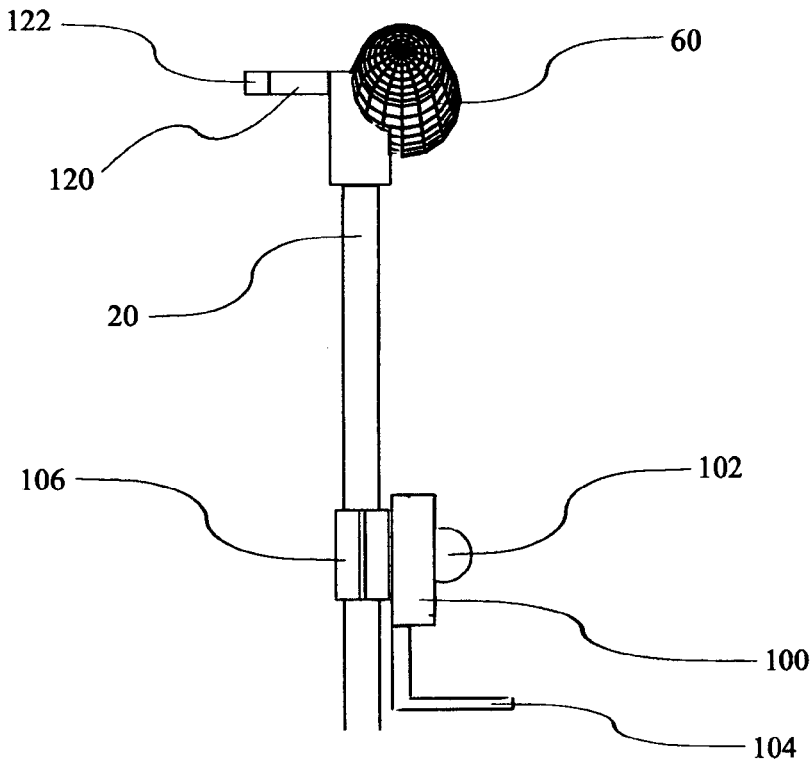
FIG. 5 is a side sectional view of the Adjustable Level component in the most preferred embodiment of the present invention.
Figure 6:
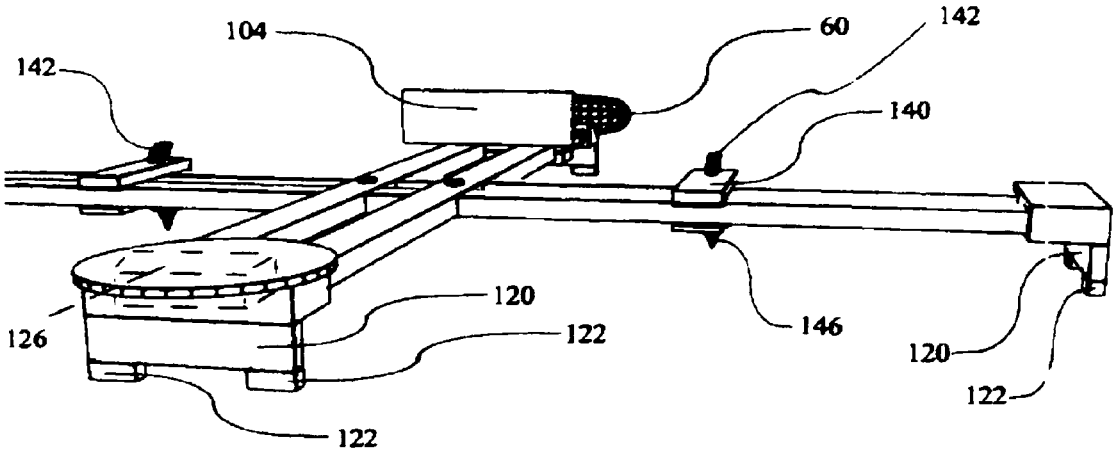
FIG. 6 is a perspective sectional view of the Leg components in the most preferred embodiment of the present invention.

Turning now descriptively to the drawings, in which similar reference characters denote similar elements throughout the several views, FIGS. 1–12, the attached FIGS. 1–12 illustrate a picture, sconce, decorative shelf, clock, artwork, mirror, and other decorative or functional item hanging device, or selected components thereof, which comprises an elongated Vertical Support member 20 attached centrally to an elongated Horizontal Support member 40. Although FIG. 1 shows such attachment via two threaded fasteners and easily removable fastening means is preferred for compact packaging, transport and storage, the type of attachment means used is not critical and permanent attachment means between Vertical Support member 20 and Horizontal Support member 40 is also contemplated. Releasable attachment means also allows for substitution of longer and shorter Support members and Horizontal Support members for quick and easy adaptation of the present invention for enhanced installation of significantly larger or smaller hung items. Although not shown, it is also contemplated for other means to be used to extend the reach of Vertical Support member 20 and Horizontal Support member 40, such as but not limited to temporarily applied extensions with snap-fit connection to ends 22, 24, 42, and 44, telescoping action of ends 22, 24, 42, and 44, and hinged extensions. In addition, although central attachment of Vertical Support member 20 and Horizontal Support member 40 is preferred in many applications, central attachment is not required. Further, simple loosening of a fastener connecting Vertical Support member 20 and Horizontal Support member 40, as opposed to its complete removal, can allow the rotation of one Support member 20 or 40 relative to the other to achieve a more compact overall configuration for transport or storage. The Vertical Support member 20 has a handle 60 at a top end 22 and a flat Surface Rest 80 at its bottom end 24 upon which the back surface of a picture, scone, or other item to be hung is positioned during centering, leveling and marking steps. Centering refers to centering within the targeted mounting area and not necessarily within an entire wall surface. While FIG. 3 shows an example of a picture frame 160 supported by the present invention, it is to be understood that other items that are not shown, such as but not limited to sconces, mirrors, artwork, ceramics, clocks, and the like, can also be hung using the present invention. Therefore, where one such item is mentioned in the Detailed Description hereinafter and elsewhere in this disclosure, unless an exclusion or exception is specifically mentioned, the mention of one type of item intended for mounting with the present invention should be also considered as a reference to any other item that can be hung with various embodiments of the present invention. The same substitution should be used for directional words, such as but not limited to 'top', 'bottom', 'upper', 'left', 'right' and the like, since the preset invention can be used in any orientation, including upside down, and the directional words were chosen arbitrarily to relate to the orientation of the present invention shown in FIGS. 1–12. Similarly, it is not intended for the word 'wall' to be restrictively used and mean only a wall, and unless otherwise specifically excluded or excepted, the word 'wall' and other words identifying a surface used for mounting an intended item should be interpreted to mean any type of mounting surface in any orientation. An integral Adjustable Level 100 is attached to the upper section of the Vertical Support member 20 and used to level the picture, sconce, or other item to be hung. Resilient Legs (shown by the number 120 in FIGS. 2, 3, 5,-7, and 12) that are compressible or flexible in some manner are connected to each end of Vertical Support member 20 and Horizontal Support member 40, and are used as stand offs to keep the device and/or the item to be hung from directly contacting the wall or other surface (not shown) to which it is contemplated for a selected item to be mounted. Sliding Hook Clips 140 can be positioned anywhere along the Horizontal Support member 40 that a mark on the targeted mounting surface is needed. Each Hook Clip 140 has a temporary hook 142 on its front side that can be used to temporarily hold a picture, sconce, or other item in position, during centering, leveling, and marking steps, via mounting holes or clips integral to the item intended for mounting or hanging. Further, unless the marking implement 146 is integral with Hook Clip 140, such as one that could scratch a mark on the targeted mounting or hanging surface, each Hook Clip 140 would have a holding receptacle 144 for a pencil or marking implement 146 on its back side and in a position perfectly aligned with the temporary hook 142 on the front. One, two, or more Hook Clips 140 can be used simultaneously, as is shown in FIGS. 1–3 and 10–12. Flexing or compression of the resilient Legs 120 reduces the wall stand off distance the Legs 120 otherwise create when wall marking is not taking place, and temporarily allows the marking implements 146 to contact and mark the wall exactly where it is intended the picture or other item should be permanently hung for a centered and level positioning. The elongated Vertical Support member 20 can consist of one or more components or rails, and in the most preferred embodiment of the present invention shown in FIG. 1, Vertical Support member 20 has two rails. The elongated Horizontal Support member 40 can also consist of one or more components or rails, with FIG. 1 showing the most preferred embodiment of the present invention Horizontal Support Member 40 having two rails. The Handle 60 is formed in a shape suitable to be held by an adult human hand and FIGS. 1–7 and 10–12 show it attached to the top end 22 of Vertical Support member 20. In the alternative, although not shown, Handle 60 may be formed in or otherwise associated with top end 22. It is preferably contemplated for Surface Rest 80 to be a substantially flat surface (as shown in FIG. 6), attached to the bottom end 24 of Vertical Support member 20, and serve as a resting surface to accommodate and support the back surface of a picture such as picture 160 in FIG. 3, or other decorative or functional item intended for mounting or hanging (not shown), while the item is being centered and leveled immediately preceding its installation. However, in the alternative, it is contemplated for Surface Rest 80 to have any other perimeter, dimension, or surface configuration that would still allow it to fulfill its intended function. The Adjustable Level 100 of the most preferred embodiment of the present invention consists of a level indicator 102, such as a bubble level, that is mounted in an assembly 104 that can rotate and slide to any position along the upper portion of Vertical Support member 20 to accommodate different sizes of pictures or other items to be hung. In addition, the Legs 120 of the most preferred embodiment of the present invention have a structure with distal and proximal ends, with a Leg 120 being used on each end of Vertical Support member 20 and Horizontal Support member 40 as a stand off to keep Horizontal Support member 40 and Vertical Support member 20, as well as the item to be hung or mounted, from directly contacting the wall during centering, leveling, and wall marking steps. The wall stand off distance can be dynamically reduced by Legs 120, or components thereof, such as but not limited to the foam pads 122 shown in FIGS. 2, 3, 5–7, and 12, other soft and compressible material applied to the distal ends of Legs 120 (not shown), and reducing movement caused as a result of a hinged or other connection between Legs 120 and Support members 20 and 40. As other wise mentioned in this disclosure, reduction of the wall stand off distance can also be accomplished by a flexing of Vertical Support member 20 and/or Horizontal Support member 40. Each of the Hook Clips 140 of the most preferred embodiment of the present invention has a U-shaped configuration with a temporary hook 142 on its front side and a pencil or marking implement 146 holding receptacle 144 on its back side, the center of receptacle 144 being positioned directly behind and aligned with the center of the cradle of its opposed temporary hook 142. on the front side. The Hook Clips 140 are designed to slide and be placed in an infinite number of positions along Horizontal Support member 40. One or more Hook Clips 140 can be used simultaneously.

The Vertical Support member 20, as shown in FIG. 1, has two elongated components or rails, although the number of elongated components is not critical and limited only by its usefulness for an intended application. Vertical Support Member 20 and Horizontal Support member 40 may be constructed of various materials such as metal, fiberglass, composite, plastic, wood, or any other material that meets the needed weight and strength requirement of a given application. FIG. 1 shows the Vertical Support member 20 crossing over and attached to the Horizontal Support member 40 at its midpoint (by fasteners which are illustrated but not numbered in FIG. 1. However, midpoint attachment is not critical. Further, although the type of fastener used is not critical, it is preferred that the attachment between Vertical Support member 20 and Horizontal Support member 40 be made with removable fasteners so that the device can be easily disassembled for packaging, transport, storage, or substitution of replacement Support members 20 or 40 for differing applications. In the alternative, such a fastener can simply be loosened to allow one Support member 20 or 40 to be rotated relative to the other to achieve a more compact overall configuration for transport or storage of the present invention device between periods of use. The Vertical Support member 20 can consist of single, double, or multiple rail components which can be of any cross-sectional profile from rectangular to round, or any other variation of shape as is functionally practical or cost effective for manufacture. Further, the Vertical Support member's 20 elongate structure can be straight, curved, bowed, or curvilinear. Also, Vertical Support member 20 can be made of any known material having the proper functional characteristics, including weight and strength considerations. In addition, the Vertical Support member 20 and Horizontal Support member 40 can be attached at any point and by any means practical, including permanent and non-permanent means.

The elongated Horizontal Support member 40 as shown in FIG. 1 also has opposite ends, identified in FIG. 1 as left end 42 and right end 44. It can consist of a unitary structure, or multiple components or rails, as shown in FIG. 1. Horizontal Support Member 40 may be constructed of various materials such as metal, fiberglass, composite, plastic, wood, or any other material that would allow it to fulfill its intended function. Cost effective manufacture is one of the factors driving material selection. Left end 42 and right end 44 each have a Leg member 120 attached to it that provides a stand off distance for keeping the Horizontal Support member 40 from contacting the wall during the centering and leveling of an item to be mounted or hung relative to the targeted mounting surface, and when marking of the wall or other mounting surface occurs. FIGS. 1–3 show Vertical Support member 20 crossing over and attached to the Horizontal Support member 40 at its approximate midpoint, although midpoint crossing is not critical. Vertical Support member 20 and Horizontal Support member 40 attachment is preferably made with removable fasteners (shown but un-numbered in FIGS. 1–3), so that the device can be easily disassembled for packaging, transport, storage, or parts replacement. Horizontal Support member 40 can consist of single, double or multiple rail components which can be of any cross sectional profile from rectangular to round or any other variation of shape as is functionally practical or cost effective for manufacture. Horizontal Support member's 40 elongate structure can be straight, curved, bowed, or curvilinear. It can also be made of any know material with the proper functional characteristics, particularly but not limited to weight and strength considerations. Horizontal Support member 40 and Vertical Support member 20 can be attached at any point and by any means practical, including permanent and non-permanent means.

Figure 7:
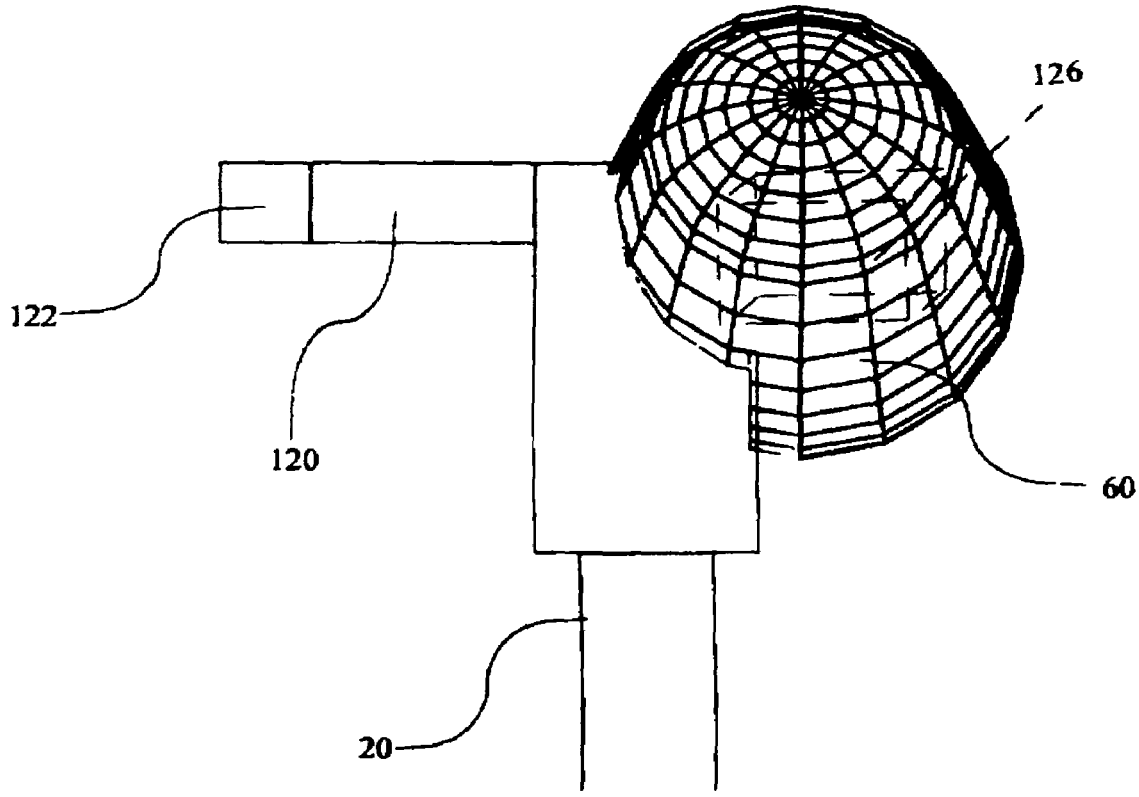
FIG. 7 is a side sectional view of the Leg component in the most preferred embodiment of the present invention that is attached to the top end of the Vertical Support member.
Figure 8:
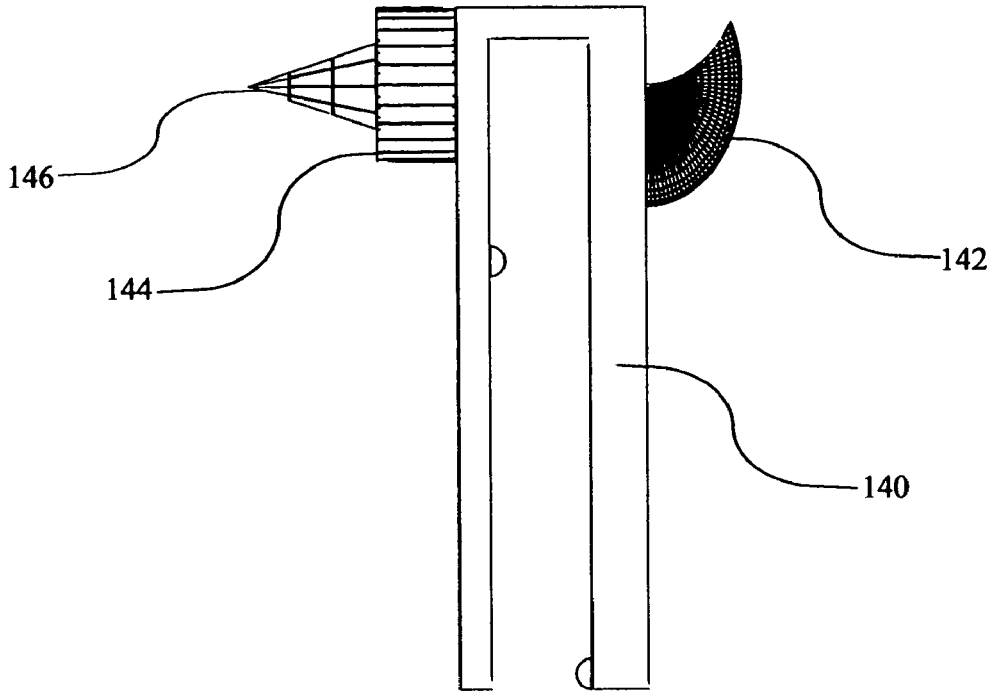
FIG. 8 is a side view of the Hook Clip component in the most preferred embodiment of the present invention.
Figure 9:
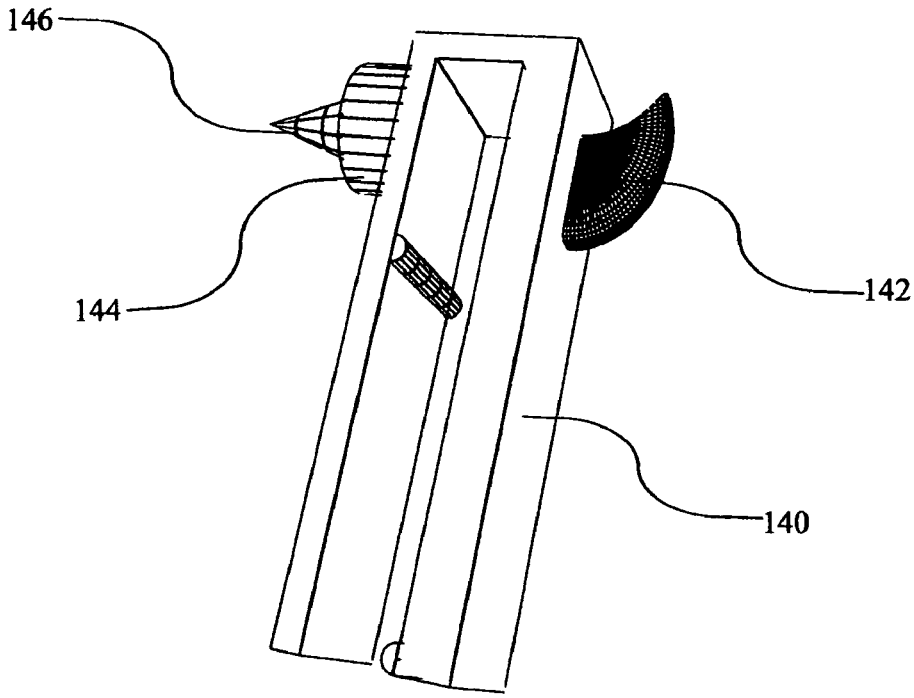
FIG. 9 is a perspective view of the Hook Clip component in the most preferred embodiment of the present invention.

The Handle 60 shown in FIG. 1 is formed in a shape suitable to be held and attached to the top end 22 of Vertical Support member 20. As shown in FIGS. 1–3, Handle 60 is preferably an ergonomic shape designed to comfortably fit an adult human hand. Handle 60 provides a grip point to hold and support the entire present invention device against the wall as a picture, sconce, or other decorative or functional item to be hung or mounted in supported thereon and moved for determining the best position for placement in the targeted mounting area, as well as during leveling and wall marking steps. As shown in FIG. 7, Handle 60 can also have an integral compartment 126 designed to hold extra marking implements 146. Handle 60 can be made of various materials such as metal, fiberglass, composite, plastic, wood, and any other functionally suitable material, or combination of materials that allows it to cost effectively fulfill its intended function. The Handle 60 can be made of any shape, dimension, and material that is practical and cost effective for its intended use. Thus, Handle 60 can be as simple as a bend, bulge, hole or slot formed in the top end 22 of Vertical Support member 20, or formed as a result of assembled construction.

The Surface Rest 80 in FIG. 1 is a substantially flat surface attached to the bottom end 24 of Vertical Support member 20, and serves as a resting surface to accommodate the back surface of a picture, sconce, or other decorative or functional item (not shown). As shown in FIGS. 1–3, Surface Rest 80 preferably has a substantially flat upper surface and provides an area upon which to hold or support a picture or other item to be hung away from its targeted wall or other mounting surface while it is being positioned and leveled relative to the targeted hanging location prior to wall marking, as well as during the wall marking step. Surface Rest 80 can be made of various materials such as metal, fiberglass, composite, plastic, wood, and any other material or combination of materials that permits it to fulfill its intended function, with cost effective manufacture being one deciding factor in material selection. As shown in FIG. 6, Surface Rest 80 can also have an integral compartment 126 designed to hold extra marking implements 146. Although in FIG. 1 the most preferred embodiment of Surface Rest 80 is shown to have a circular profile, it can actually have any surface texture or marking, shape, and/or perimeter configuration that a picture, sconce, or other decorative or functional item intended for hanging or mountin can rest upon prior to, during, or after wall marking.

The Adjustable Level 100 shown in FIG. 1 consists of a level indicator 102, such as a bubble level, that is mounted with contact plane 104 into an assembly which can rotate and slide to any position along the top portion of Vertical Support member 20 to accommodate different size pictures, sconces, and other decorative or functional items intended for hanging. As shown in FIGS. 4 and 5, Adjustable Level 100 also has a rail clip 106. Although not shown, the assembly formed by level indicator 102 and contact plane 104 is connected to rail clip 106 by means of a shaft or single fastener that allows assembly rotation relative to the rail clip 106. Further, although not shown, rail clip 106 is attached to Vertical Support member 20 in such away as to allow the Adjustable Level 100 to slide into any position along the upper portion of Vertical Support member 20. Adjustable Level 100 can be made of various materials such as metal, fiberglass, composite, plastic, wood, and any other material or combination of materials that allow it to fulfill its intended function. The level indicator 102 can be a bubble level, or any other commonly known or used visual level indicator. Further, the Adjustable Level 100 can be permanently or removably mounted to Vertical Support member 20. Also, the level indicator 102 can be permanently mounted, or readily removable.

The Legs 120 shown in FIGS. 2–7, and 12 each have a structure with a distal end and a proximal end, with top end 22 and bottom end 24 of Vertical Support member 20 and left end 42 and right end 44 of Horizontal Support member 40 each having a Leg 120 that is used as a stand off to keep the Horizontal Support member 20 and Vertical Support member 40 from directly contacting the wall or other vertically extending surface to which an item is to be hung in a targeted mounting location. The wall stand off distance can be dynamically reduced by a means of either direct flexing or compression of Legs 120, and/or components thereof, such as but not limited to the foam pads 122 shown in FIGS. 2–7, and 12. As shown in FIGS. 6–7, and also in FIGS. 2–3, the distal end of each Leg 120 where contact with the wall occurs has at least one resilient compressible foam pad 122. The foam pad(s) 122 extend the wall stand off length of the Leg(s) 120 and act as a dynamically compressible stand off mechanism. Through the use of the foam pad(s) 122 and resilient Legs 120, the marking implement(s) 146 are routinely kept a miniscule distance away from touching the wall or other surface targeted for hanging or mounting. Then, when marking of the targeted mounting surface is desired, a wall-ward pressure is applied to the entire device, the foam pad(s) 122 compress, the wall stand off distance is reduced, and the marking implement(s) 146 is allowed to come into direct contact with the targeted wall or other mounting surface. Foam pad(s) 122 additionally serve to prevent/cushion the wall contact, thus preventing scraping, damage and undesirable marks thereto. The Leg(s) 120 can be made of various materials such as metal, fiberglass, composite, plastic, wood, and other any other material or materials that allow them to fulfill their intended function. Material selection is in part dictated by durability over extended periods of repeat use. The foam pad(s) 122 can be made of any resilient, compressible, or other material that allows significant compression and then returns to its original shape shortly thereafter. Leg(s) 120, Horizontal Support member 40, Vertical Support member 20, or a combination thereof, can also be designed to flex or compress so as to allow dynamic reduction in the wall stand off distance that will allow the marking implement(s) 146 to come into contact with the targeted mounting surface or wall. Flexing or compression can be accomplished by a numbers of means, including elastic, flexible or compressible materials, springs, shocks, torsion mechanisms, and/or mechanical means.

Figure 10:
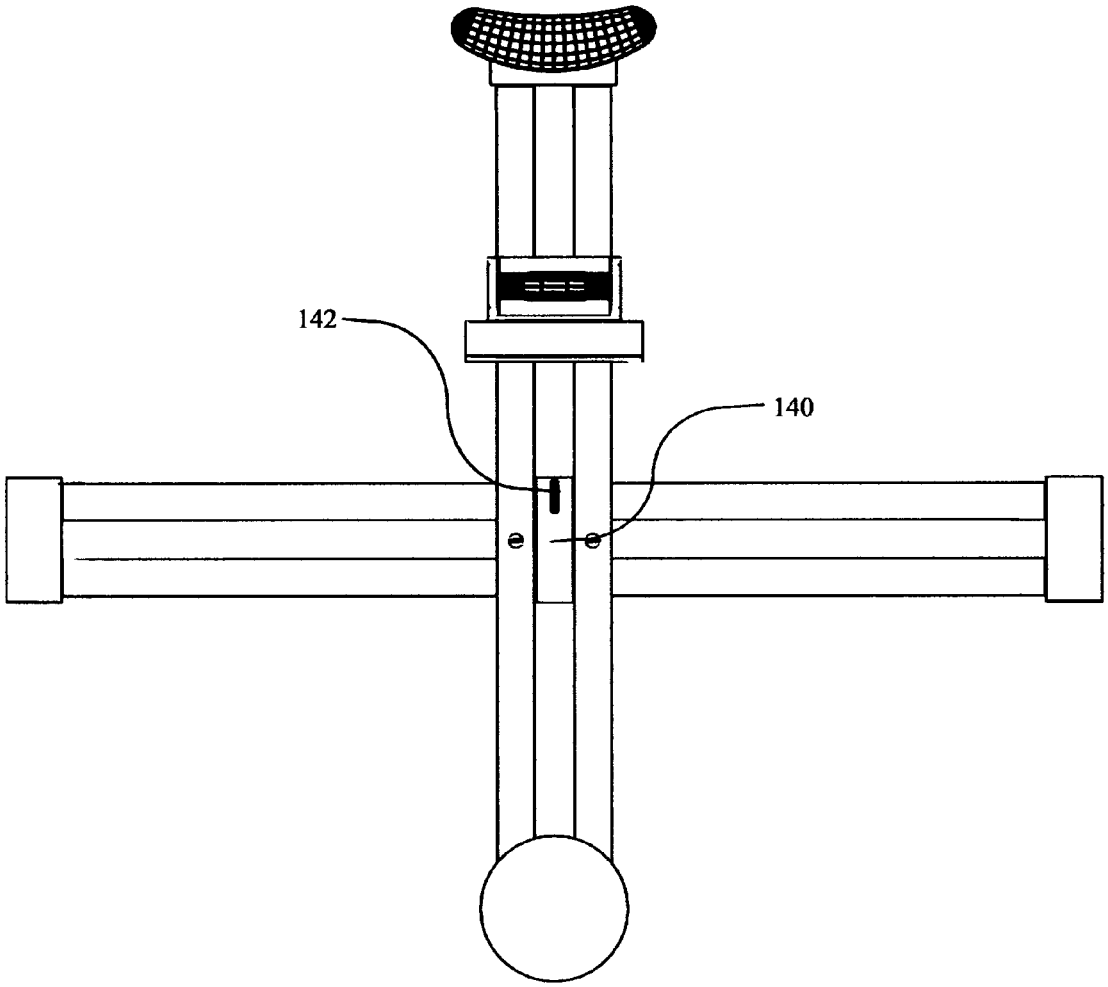
FIG. 10 is a front view of the most preferred embodiment of the present invention with one Hook Clip in centered position along the Horizontal Support member.
Figure 11:
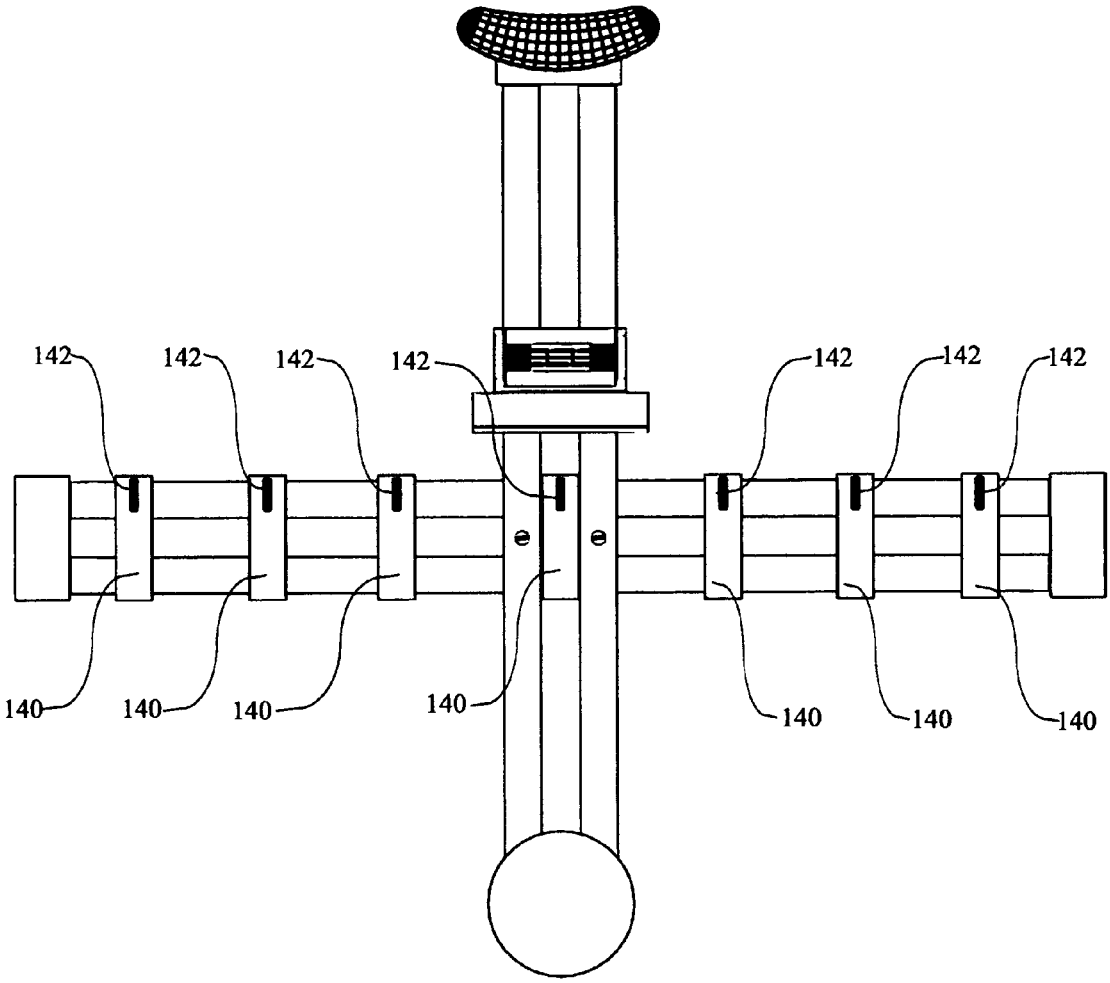
FIG. 11 is a front view of the most preferred embodiment of the present invention with its U-shaped multiple Hook Clips mounted.
Figure 12:
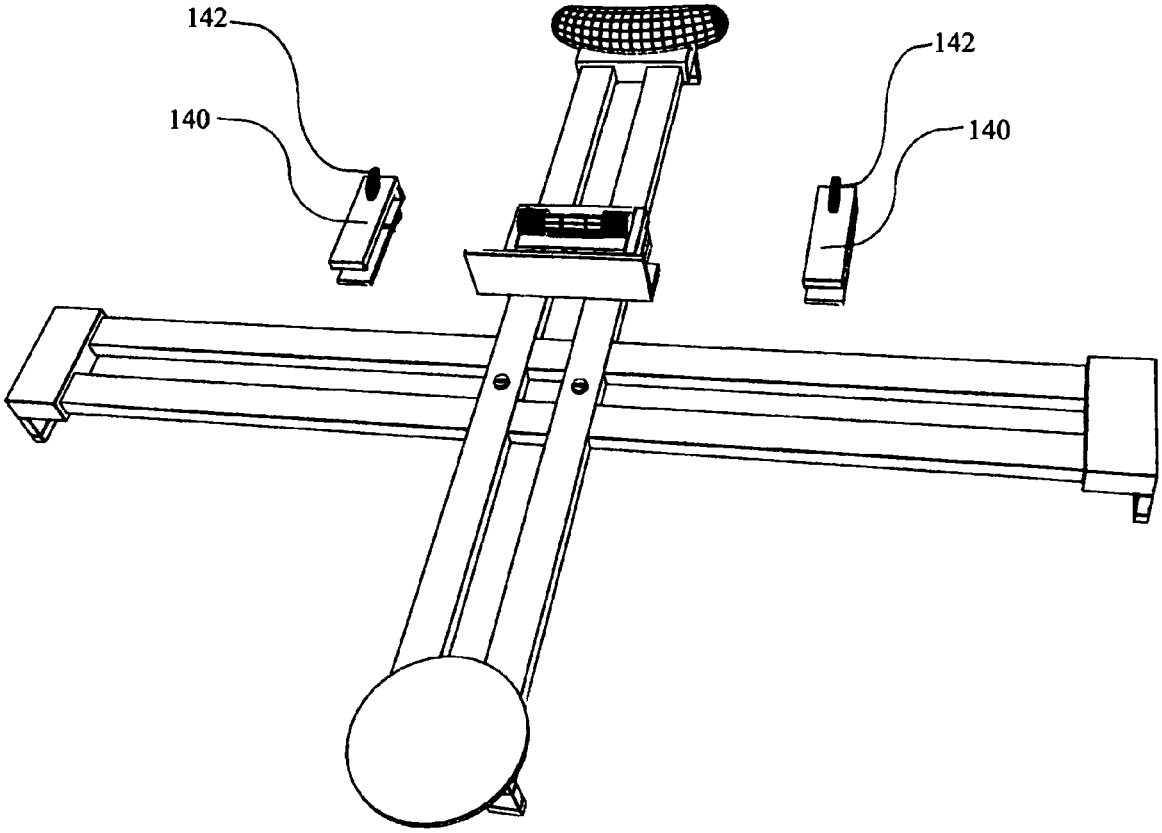
FIG. 12 is a front view of the most preferred embodiment of the present invention with Hook Clips shown removed.

Each of the Hook Clips 140 shown in FIGS. 1–6 and 9–12 has a U-shaped configuration with a temporary hook 142 on its front side and a pencil or marking implement 146 holding receptacle 144 on its back side, the center of which is directly behind and aligned with the center of the cradle of the temporary hook 142 on the front side. Hook Clips 140 are designed to slide and/or be placed at any position along Horizontal Support member 40. One, two, or multiple Hook Clips 140 can be used simultaneously on Horizontal Support member 40. Although the two Hook Clips 140 shown in FIGS. 1–4, 6 and 12 are used in many applications, one Hook Clip 140 can be used in the center position along Horizontal Support member 40 (as shown in FIG. 10), and multiple Hook Clips 140 can be used simultaneously along Horizontal Support member 40 (as shown in FIG. 11). Hook Clips 140 are designed to be invertible and can be mounted right side up or upside down on the Horizontal Support member. Hook Clip(s) 140 can be made of various materials such as metal, fiberglass, composite, plastic, wood, and any other material that allows it to fulfill its intended function. Hook Clip(s) 140 can be made to be attached to the Horizontal Support member 40 in a removable or non-removable fashion. They can be made to have infinite sliding positions or discrete stop positions. Although not shown, the Hook Clip(s) 140 can also be made to have a position lock mechanism built in.

In summary, the Vertical Support member 20 is an elongate structure having a top end 22 and a bottom end 24. The top end 22 of Vertical Support member 20 is attached to Handle 60, which is used as grip point to hold the present invention in combination with an item intended for mounting against a targeted surface as the item is being centered and leveled for wall marking. The bottom end 24 of Vertical Support member 20 is attached to Surface Rest 80, which provides a surface for resting the back of a picture, sconce, or other item to be mounted or hung so it is held away from the wall while it is being leveled and positioned for final placement. Top end 22 and bottom end 24, as well as left end 42 and right end 44 of Horizontal Support member 40, have Leg(s) 120 that provide a stand off distance keeping the Support member 20 and 40, as well as the item intended for mounting away from contacting the wall. The Vertical Support member 20 crosses over and is attached to the Horizontal Support member 40 at its approximate midpoint, although not limited thereto. This Vertical Support member 20 and Horizontal Support member 40 attachment is preferably made with removable fasteners so that the device can be easily disassembled for initial packaging, transport, storage, and replacement of parts. Leg(s) 120 have a distal end and a proximal end, with resilient material such as but not limited to compressible foam pad(s) 122 at the proximal end of each Leg 120 where contact with the wall or other mounting surface occurs. The foam pad(s) 122 or other soft/compressible material, extend the wall stand off distance of Leg(s) 120 and act as a dynamically compressible stand off mechanism. Through the use of the foam pad(s) 122 or other material with compressible characteristics, the marking implement(s) 146 held in receptacle(s) 144 are kept a miniscule distance away from touching the wall. Then, when wall marking is desired, a wall-ward pressure is applied to the entire device, the foam pad(s) 122, other soft material, and/or Legs 120 compress to reduce the wall stand off distance and allow the marking implement(s) 146 to come into contact with and mark the adjacent wall or other targeted mounting surface. Foam pad(s) 122 and other soft material similarly applied to Legs 120, additionally serve to cushion the Leg(s) 120 contact with the wall and prevent scraping, damage and undesirable marks from being made thereon. To accomplish the leveling and marking operation, a picture, sconce, or other item is temporarily supported or hung upon the present invention by means of the mating of the temporary hook(s) 142 on Hook Clip(s) 140 with the integral mounting holes or mounting clips on the back surface of the item intended for mounting. Hook Clip(s) 140 are designed to slide or be placed at any position along Horizontal Support member 40. Each Hook Clip 140 in the most preferred embodiment of the present invention has a U-shaped configuration designed to slip over and fit onto Horizontal Support member 40. However, a U-shaped configuration is not critical. It is preferred that any configuration of Hook Clips 140 used remain in place when the present invention is inverted, to allow effective use of the present invention in any spatial orientation. The U-shaped configuration includes a hook 142 on its front side and a pencil or marker 146 holding receptacle 144 on its back side, the center of which is directly behind and aligned with the center of the cradle of the hook 142 on the front side. Although two Hook Clip(s) 140 are used in many applications (as shown in FIG. 1), one Hook Clip 140 can be used in the center position of Horizontal Support member 40 (as shown in FIG. 10), or multiple Hook Clip(s) 140 can be used simultaneously (as shown in FIG. 11). A picture, sconce, or other item intended for mounting is temporarily hung on the hook 142 of each Hook Clip 140 present. Consequently the number of Hook Clip(s) 140 used for a leveling and marking operation is dependent on the number of integral mounting holes or mounting clips on the item being hung. Once the picture, sconce, or other item is temporarily hung onto the invention by the temporary hook(s) 142 of Hook Clip(s) 140, the leveling operation is performed by using the Adjustable Level 100. The Adjustable Level 100 is mounted by means of rail clip 106 so as to be able to slide up and down the upper segment of the Vertical Support member 20. The Adjustable Level 100 consists of a level indicator 102, such as a bubble level, a contact plane 104, and a rail clip 106. The level indicator 102 and the contact plane 104 are mounted together as an assembly that is connected to the rail clip 106 by means of a shaft or single fastener that allows rotation. The level indicator 102 and the contact plane 104 can be rotated relative to the rail clip 106 and the rest of the invention. The rail clip 106 is attached to Vertical Support member 20 in such away as to allow the Adjustable Level 100 to slide into any position along the top portion of the Vertical Support member 20. The sliding positionability of the Adjustable Level 100 allows this invention to accommodate different size pictures, sconces, and other decorative items to be hung. To level a supported picture, sconce or other decorative item, the contact plane 104 is moved into contact with its top edge. It may be necessary to rotate the level indicator 102 and contact plane 104 so that the contact plane 104 is parallel to the top of the item to be hung. The ability of the level indicator 102 and contact plane 104 to rotate relative to the rest of the invention allows the device to compensate for pictures, sconces, or other items with integral mounting holes or mounting clips that are out of alignment with each other. Once the contact plane 104 is in direct contact and parallel with the top edge of the item to be hung, the level indicator 102 will show the levelness of the picture or sconce relative to the ground or floor below it. If out of level, the entire invention including the item being supported thereby, can be rotated on the wall relative to the ground/floor, making the final adjustment to bring the item to be hung into a level orientation relative to the ground/floor, so marks that are first-time accurate can be made on the wall/surface for mounting the picture, sconce, or other item thereon. For marking the wall or other mounting surface, a wall-ward pressure is applied to the entire device, the foam pad(s) 122, other soft material, and/or Legs 120, Vertical Support member 24, and Horizontal Support member 40 compress, the stand off distance is reduced and the marking implement(s) 146 come into direct contact with the wall or other targeted mounting surface, allowing the desired marks to be made in exact alignment with the integral mounting holes or mounting clips on the item intended for mounting, which have been temporarily hung on temporary hook(s) 142. The marks that are made on the wall by the present invention will perfectly compensate for inaccuracies in the item selected for hanging or mounting. If hung at such marks, the picture, sconce, or other item will be perfectly level with the adjacent ground/floor even if its integral mounting holes or mounting clips are grossly out of alignment. Whether the Vertical Support member 20 and Horizontal Support member 40 have single, double or multiple rail components, or rail components of any cross sectional profile from rectangular to round or any other variation of shape as is functionally practical, is not critical for the present invention. In addition, the elongate Vertical Support member 20 and Horizontal Support member 40 can be straight, curved, bowed or curvilinear, and/or can be attached at any point and by any means practical, including permanent and detachable means. The shape of Handle 60 is also not critical, as long as it assists a user in obtaining a firm grip on the present invention while it holds or supports an item before, during, and after wall marking takes place. Also, the material from which Handle 60 is made can be any material practical for such use. Further, although not shown, Handle 60 can have a compartment for holding marking implement(s) 146. Further, Handle 60 can be as simple as a bend, bulge, hole or slot on the upper end 22 of Vertical Support member 20. The configuration of Surface Rest 80 is also not critical, and it can be of any surface and shape configuration that the back of a picture, sconce or other item can safely rest upon without damage. A Surface Rest 80 is typically attached to the bottom end 24 of Vertical Support member 20, but may also be attached to the left end 42 and/or right end 44 of Horizontal Support member 40. The Adjustable Level 100 can be mounted permanently or non-permanently to Vertical Support member 20. The level indicator 102 can be any visually readable leveling device, including a bubble level, electronic level or mechanical level. The level indicator 102 can also be permanently or detachably mounted. Leg(s) 120, Horizontal Support member 40, or Vertical Support member 20, can all be designed to flex or compress alone or in combination, so as to allow dynamic reduction in the wall stand off distance that will allow the marking implement(s) 146 to momentarily come into contact with the wall. Flexing or compression can be accomplished by a numbers of means, including elastic, flexible or compressible materials, springs, shocks, torsion mechanisms, and/or mechanical means. The Hook Clip(s) 140 of the most preferred embodiment of the present invention can be made to be attached to the Horizontal Support member 40 in a removable or non-removable fashion. Hook Clip(s) 140 can be made to have infinite sliding positions or discrete stop positions. Hook Clip(s) 140 can be designed for attachment in an upside down position relative to the device and hold without falling. Although not shown, the Hook Clip(s) 140 can be made to have a position lock mechanism built in. This invention or any of its components may be constructed of various materials such as metal, fiberglass, composite, plastic, wood, and any other material allowing it to fulfill its intended function.

As shown in FIG. 3, operation of the present invention begins by temporarily placing or suspending a picture 160, sconce, or other item intended for mounting, from the temporary hook(s) 142 on Hook Clip(s) 140 via mounting holes, clips, or other means integral with the back surface of the item intended for hanging or mounting. The back of the picture 160 or other item rests in substantial part against Surface Rest 80. Although Surface Rest is shown in FIG. 3 for illustrative purposes, it should be noted that Surface Rest 80 and the portions of Vertical Support member 20 and Horizontal Support member shown between the perimeter edges of picture 160 would normally be hidden from view behind picture 160. Surface Rest 80 also serves to hold the picture 160 or other item vertically in line, relative to Hook Clip(s) 140 during the wall positioning and leveling operation. The user/installer (not shown) then grasps Handle 60 and places the device with the suspended picture 160 or other item against the subject/targeted wall or other mounting surface for the positioning operation by which the item to be mounted is visually centered within the targeted mounting location. Leg(s) 120 serve as stand offs to keep the components of the present invention device from fully contacting the targeted wall or other mounting surface. Additionally, when used the resilient compressible foam pad(s) 122 or other soft material, such as but not limited to felt, will add a slight amount of stand off distance that is dynamically compressible. This slight amount of stand off distance provided by the foam pad(s) 122 serves to keep the marking implement(s) 146 away from touching the wall during the positioning operation. The present invention device is moved about the wall surface until the desired preliminary hanging position is found. Once the preliminary position is determined, the picture 160 or other item must be leveled. To do this the Adjustable Level 100 is slid down the Vertical Support member 20 until the contact plane 104 touches the top of the picture 160 or other item. Contact plane 104 is rotated relative to rail clip 106, until it is parallel with the top of the picture 160 or other item. The level indicator 102 is then read. If the level indicator 102 reads out of level, it is an indication that the integral mounting holes or mounting clips in the back of the picture 160 or other item may be out of level or misaligned relative to one another. To compensate for this and to hang the picture 160 or other item level, the entire present invention device along with the suspended picture 160 or other item is rotated slightly on the wall by means of handle 60 until the level indicator 102 reads level. Once level is achieved, the top of the picture 160 or other item will be level with the ground or floor beneath it no matter how much out of alignment the integral mounting holes in or mounting clips on the back of picture 160 or other item are. Now to mark the exact position on the mounting surface where mounting hooks should be placed to mount the intended item or picture 160 level and in the desired position with first-time accuracy, the user/installer will simply apply a wall-ward pressure to the present invention device sufficient for Leg(s) 120 and/or foam pad(s) 122, Vertical Support member 20, Horizontal Support member 40, or other soft/compressible material, such as but not limited to felt, to be compressed and bring the tips of the marking implement(s) 146 into direct contact with the wall to thereby mark the final wall hook placement positions. These marks will be perfectly positioned and aligned for level placement because the tips of the marking implement(s) 146 are perfectly centered to the cradle of hook(s) 142 on the Hook Clip(s) 140.

Additional manners of usage and operation of the present invention will be apparent from the above description. Accordingly, no further discussion relating to the usage and operation of the present invention is provided. In addition, with respect to the above description, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the scope of the present invention. Therefore, the foregoing Detailed Description and other disclosure is considered merely illustrative of the principles of the invention. Further, since numerous modifications and changes will readily occur to those skilled in the art, it is not desired to limit the invention to the exact construction and operation shown and described, and accordingly, all suitable modifications and equivalents may be resorted to, and considered to fall within the scope of the present invention.

What is claimed is:

1. A device for easy positioning, leveling, marking and mounting in a desired position on a targeted surface, all types of pictures, sconces, decorative shelves, mirrors, and other decorative and functional items intended for hanging and other types of mounting, where each item to be mounted has a back surface and at least one desired location on that back surface from which it is intended for mounting to take place, said device comprising:

an elongated vertical support member having opposed ends and an upper portion, with one of said opposed ends being a top end and the other of said opposed ends being a bottom end and further wherein said upper portion is remote from said bottom end;

an elongated horizontal support member having opposite ends and being attached to said vertical support member;

a plurality of legs attached to said vertical support member and said horizontal support member in association with said opposed and opposite ends;

handle means associated with said top end of said vertical support member;

a surface rest associated with said bottom end of said vertical support member that is configured for holding the back surface of the item to be mounted;

adjustable level means associated with said upper portion of said vertical support member; and sliding hook clip means associated with said horizontal support member and adapted for positioning at any location on said horizontal support member, said sliding hook clip means having aligned hooking means and marking means that face in opposite directions front one another so that when the item to be mounted upon a targeted surface is positioned upon said surface rest and said sliding hook clip means is moved to line up the aligned hooking and marking means with all of the desired locations on the back surface of that item from which it is intended for mounting thereof on the targeted surface to take place, and further when said hooking means temporarily holds the item at the desired mounting locations on its back surface and said adjustable level means is moved along said upper portion of said vertical support member until said level means comes into contact with the item intended for mounting, and after said device is positioned at a stand off distance from the targeted mounting surface by said legs, a user of said device while manipulating said device at least in part by use of said handle visually centers the item relative to the targeted mounting surface and places the item into a level orientation using said adjustable level means, and thereafter applies a wall-ward force to said device that temporarily reduces the stand off distance a sufficient amount to allow said marking means to contact the targeted mounting surface and leave a visible reference mark thereon exactly where mounting hardware for the item should be placed to achieve first-time accurate and level mounting of the item in a desired location on the targeted mounting surface.

2. The device of claim 1 wherein said legs each further comprise a distal end, and further wherein structure responsible for reduction of the stand off distance a sufficient amount to allow said marking means to contact the targeted mounting surface and leave a visible reference mark is selected from a group consisting of flexible legs, compressible legs, vertical support members made from flexible material, horizontal support members made from flexible material, foam pads associated with said distal ends, and compressible material associated with distal ends.

3. The device of claim 1 wherein said legs are selected from a group consisting of compressible legs, flexible legs, legs made from at least one type of compressible material, legs made from at least one type of flexible material, legs made from at least one type of elastic material, legs made from spring material, legs made from shock-absorbing material, legs having torsion means, and legs having mechanical compression means.

4. The device of claim 1 wherein said legs each further comprise a distal end configured to prevent injury to, or inadvertent marking of, the targeted mounting surface during contact therewith when positioning, leveling, and reduction of the stand off distance occurs.

5. The device of claim 1 wherein said sliding hook clip means is selected from a group consisting of detachable sliding hook clip means, non-detachable hook clip means, and invertible hook clip means.

6. The device of claim 1 wherein said vertical support member and said horizontal support member are selected from a group consisting of vertical support members having a single rail, vertical support members having multiple rails, horizontal support members having a single rail, and horizontal support members having multiple rails.

7. The device of claim 1 wherein said marking means is selected from a group consisting of marking implements configured for attachment to said hook clip means and marking implements integral to said hook clip means.

8. The device of claim 7 wherein said handle has a compartment configured for holding at least one said marking implement.

9. The device of claim 7 wherein said resurface rest has a compartment configured for holding at least one said marking implement.

10. The device of claim 7 further comprising a holding receptacle associated with said hook clip means, and wherein said holding receptacle is configured to secure said marking implements for use.

11. The device of claim 1 wherein said adjustable level means comprises a level indicator, a contact plane, and a rail clip.

12. The device of claim 1 wherein said adjustable level means is selected from a group consisting of detachable level means, non-detachable level means, level means adapted to slide longitudinally along said vertical support means, and level means adapted to rotate relative to said vertical support means.

13. The device of claim 1 wherein attachment of said vertical support member to said horizontal support member is selected from a group consisting of permanent attachment means, non-permanent attachment means, and easily removable attachment means.

14. The device of claim 1 wherein said marking means is selected from a group consisting of marking implements that make a discrete mark within the target surface and marking implements that deposit marking material on the target surface.

15. The device of claim 1 wherein said legs are selected from a group consisting of compressible legs, flexible legs, legs made from at least one type of compressible material, legs made from at least one type of flexible material, legs made from at least one type of elastic material, legs made from spring material, legs made from shock-absorbing material, legs having torsion means, and legs having mechanical compression means.

16. The device of claim 1 wherein said sliding hook clip means and said adjustable level means are selected from a group consisting of detachable means and non-detachable means.

17. The device of claim 1 wherein said vertical support member and said horizontal support member are selected from a group consisting of vertical support members having a single rail, vertical support members having multiple rails, horizontal support members having a single rail, horizontal support members having multiple rails, support members permanently attached to one another, and support members readily detachable from one another.

18. A method for easy positioning, leveling, marking and mounting in a desired position on a targeted surface, all types of pictures, sconces, decorative shelves, mirrors, and other decorative and functional items intended for hanging and other types of mounting, said method comprising the steps of:

providing a targeted mounting surface, a mountable item having a back surface with at least one desired location from which it is intended for mounting against said targeted mounting surface to take place, an elongated vertical support member having opposed ends, an elongated horizontal support member having opposite ends, a plurality of legs attached to said vertical support member and said horizontal support member in association with said opposed and opposite ends, handle means associated with one of said opposing ends of said vertical support member, a surface rest configured for holding the back surface of the mountable item and in a remote position from said handle on said vertical support member, adjustable level means slidably and rotatably associated with said vertical support member, and sliding hook clip means associated with said horizontal support member and able to be positioned anywhere on said horizontal support member between said opposite ends with said hook clip means having aligned hooking means and marking means that face in opposite directions from one another;

positioning said item on said support rest;

sliding said hook clip means so that said hooking means is moved to line up with and temporarily engage said at least one desired mounting location on said back surface of said item;

sliding and rotating said adjustable level means relative to said vertical support member until said level means comes into contact with an adjacent portion of said item;

using said legs to position said vertical support member and said horizontal support member at a stand off distance from said targeted mounting surface;

visually centering said item in a desired position relative to said targeted mounting surface;

using said adjustable level means to place said item into a level orientation; and applying a wall-ward force to said vertical support member and said horizontal su port member that temporarily reduces said stand off distance a sufficient amount to allow said marking means to contact said targeted mounting surface and leave a visible reference mark thereon exactly where mounting hardware for said item should be placed to achieve first time accurate and level mounting of said item in a desired location on said targeted mounting surface.

19. The method of claim 18 wherein said step of using said legs also includes simultaneous manipulation of said vertical support member at least in part by use of said handle.

20. The method of claim 18 wherein said legs each further comprise a distal end, and further wherein structure responsible for reduction of the stand off distance a sufficient amount to allow said marking means to contact the targeted mounting surface and leave a visible reference mark is selected from a group consisting of flexible legs, compressible legs, vertical support members made from flexible material, horizontal support members made from flexible material, foam pads associated with said distal ends, and compressible material associated with distal ends.

* * * * *